US008947449B1

(12) United States Patent
Dodd

(10) Patent No.: US 8,947,449 B1
(45) Date of Patent: Feb. 3, 2015

(54) COLOR SPACE CONVERSION BETWEEN SEMI-PLANAR YUV AND PLANAR YUV FORMATS

(75) Inventor: Michael Dodd, Seattle, WA (US)

(73) Assignee: Google Inc., Mountain View, CA (US)

( * ) Notice: Subject to any disclaimer, the term of this patent is extended or adjusted under 35 U.S.C. 154(b) by 255 days.

(21) Appl. No.: 13/401,789

(22) Filed: Feb. 21, 2012

(51) Int. Cl.
*G09G 5/02* (2006.01)

(52) U.S. Cl.
USPC ..... 345/604; 345/603

(58) Field of Classification Search
CPC ..... G06K 9/2018; G06T 7/408; G06T 5/001; G06T 2207/10024; G06T 11/001; H04N 1/38; G09G 5/02; G09G 2340/06; G09G 2320/0673
USPC ..... 345/426, 453, 153, 155, 156, 600, 345/603–605; 382/163
See application file for complete search history.

(56) References Cited

U.S. PATENT DOCUMENTS

| | | | | |
|---|---|---|---|---|
| 6,674,479 | B2 * | 1/2004 | Cook et al. | 348/453 |
| 7,298,379 | B2 | 11/2007 | Xu et al. | |
| 7,580,456 | B2 | 8/2009 | Li et al. | |
| 7,961,784 | B2 | 6/2011 | Demos | |
| 7,970,206 | B2 | 6/2011 | Harris et al. | |
| 8,005,144 | B2 | 8/2011 | Ji et al. | |
| 8,014,611 | B2 | 9/2011 | Morohashi | |
| 8,259,809 | B2 | 9/2012 | Lin | |
| 2005/0201464 | A1 | 9/2005 | Lee | |
| 2007/0002048 | A1 * | 1/2007 | Takashima et al. | 345/426 |
| 2008/0260031 | A1 | 10/2008 | Karczewicz | |
| 2011/0026820 | A1 | 2/2011 | Strom et al. | |
| 2011/0085027 | A1 | 4/2011 | Yamashita et al. | |
| 2011/0170006 | A1 | 7/2011 | Evans et al. | |
| 2011/0182357 | A1 | 7/2011 | Kim et al. | |
| 2011/0216968 | A1 * | 9/2011 | Fillion et al. | 382/163 |

(Continued)

FOREIGN PATENT DOCUMENTS

| | | |
|---|---|---|
| EP | 0765087 | 3/1997 |
| EP | 1206881 | 5/2002 |

(Continued)

OTHER PUBLICATIONS

Bankoski et al. "Technical Overview of VP8, an Open Source Video Codec for the Web". Dated Jul. 11, 2011.

(Continued)

*Primary Examiner* — Kee M Tung
*Assistant Examiner* — Nicole Gillespie
(74) *Attorney, Agent, or Firm* — Young Basile Hanlon & MacFarlane P.C.

(57) ABSTRACT

A system and techniques for converting a source image frame in a particular YUV format to another YUV format is presented. The system can include a texture component, a luminance component, and a chrominance component. The texture component can be configured to generate luminance input pixels and chrominance input pixels from the source image. The luminance input pixels can each include a luma component and the chrominance input pixels can each include a first chroma component and a second chroma component. The luminance component can be configured to generate luminance output pixels, where the luminance output pixels can each include a group of luminance input pixels. The chrominance component can be configured to generate chrominance output pixels, where the chrominance output pixels can each include a group of first chroma components or a group of second chroma components.

22 Claims, 12 Drawing Sheets

(56) References Cited

U.S. PATENT DOCUMENTS

| | | | | |
|---|---|---|---|---|
| 2011/0235930 | A1 | 9/2011 | Kim et al. | |
| 2011/0249734 | A1 | 10/2011 | Segall et al. | |
| 2011/0261886 | A1 | 10/2011 | Suzuki et al. | |
| 2012/0163464 | A1 | 6/2012 | Edelhaeusser et al. | |
| 2013/0027584 | A1 * | 1/2013 | Zerwick | 348/234 |

FOREIGN PATENT DOCUMENTS

| | | |
|---|---|---|
| GB | 2317525 | 3/1998 |
| WO | W09740628 | 10/1997 |

OTHER PUBLICATIONS

Bankoski et al. "VP8 Data Format and Decoding Guide" Independent Submission. RFC 6389, Dated Nov. 2011.

Bankoski et al. "VP8 Data Format and Decoding Guide; draft-bankoski-vp8-bitstream-02" Network Working Group. Internet-Draft, May 18, 2011, 288 pp.

Cheung, H. K. and W.C. Siu, "Local affine motion prediction for h.264 without extra overhead," in IEEE Int. Symposium on circuits and Systems (ISCAS), 2010.

Implementors' Guide; Series H: Audiovisual and Multimedia Systems; Coding of moving video: Implementors Guide for H.264: Advanced video coding for generic audiovisual services. H.264. International Telecommunication Union. Version 12. Dated Jul. 30, 2010.

Overview; VP7 Data Format and Decoder. Version 1.5. On2 Technologies, Inc. Dated Mar. 28, 2005.

Kordasiewicz, R. C., M. D. Gallant and S. Shirani, "Affine motion prediction based on transalational motion vectors," IEEE Trans. Circuits Syst. Video Technol. vol. 17, No. 10, pp. 1388-1394, Oct. 2007.

Series H: Audiovisual and Multimedia Systems; Infrastructure of audiovisual services—Coding of moving video. H.264. Advanced video coding for generic audiovisual services. International Telecommunication Union. Version 11. Dated Mar. 2009.

Series H: Audiovisual and Multimedia Systems; Infrastructure of audiovisual services—Coding of moving video. H.264. Advanced video coding for generic audiovisual services. International Telecommunication Union. Version 12. Dated Mar. 2010.

Series H: Audiovisual and Multimedia Systems; Infrastructure of audiovisual services—Coding of moving video. H.264. Amendment 2: New profiles for professional applications. International Telecommunication Union. Dated Apr. 2007.

Series H: Audiovisual and Multimedia Systems; Infrastructure of audiovisual services—Coding of moving video. H.264. Advanced video coding for generic audiovisual services. Version 8. International Telecommunication Union. Dated Nov. 1, 2007.

Series H: Audiovisual and Multimedia Systems; Infrastructure of audiovisual services—Coding of moving video; Advanced video coding for generic audiovisual services. H.264. Amendment 1: Support of additional colour spaces and removal of the High 4:4:4 Profile. International Telecommunication Union. Dated Jun. 2006.

Series H: Audiovisual and Multimedia Systems; Infrastructure of audiovisual services—Coding of moving video; Advanced video coding for generic audiovisual services. H.264. Version 1. International Telecommunication Union. Dated May 2003.

Series H: Audiovisual and Multimedia Systems; Infrastructure of audiovisual services—Coding of moving video; Advanced video coding for generic audiovisual services. H.264. Version 3. International Telecommunication Union. Dated Mar. 2005.

VP6 Bitstream & Decoder Specification. Version 1.02. On2 Technologies, Inc. Dated Aug. 17, 2006.

VP6 Bitstream & Decoder Specification. Version 1.03. On2 Technologies, Inc. Dated Oct. 29, 2007.

VP8 Data Format and Decoding Guide. WebM Project. Google On2. Dated: Dec. 1, 2010.

* cited by examiner

COLOR SPACE CONVERSION BETWEEN SEMI-PLANAR YUV AND PLANAR YUV FORMATS

TECHNICAL FIELD

This disclosure relates generally to image and/or video processing, and more specifically, to conversion between semi-planar YUV and planar YUV color space formats.

BACKGROUND

In image and/or video processing, there are various YUV color space formats. YUV color space formats can include, for example, subsampled formats and non-subsampled formats (e.g., full resolution data). Each YUV color space format can include a luminance component and a chrominance component. The luminance component contains brightness information of an image frame (e.g., data representing overall brightness of an image frame). The chrominance component contains color information of an image frame. Often times, the chrominance component is a sub-sampled plane at a lower resolution. Sampled formats in YUV can be sampled at various sub-sampling rates, such as 4:2:2 and 4:2:0. For example, a sub-sampling rate of 4:2:2 represents a sampling block that is four pixels wide, with two chrominance samples in the top row of the sampling block, and two chrominance samples in the bottom row of the sampling block. Similarly, a sub-sampling rate of 4:2:0 represents a sampling block that is four pixels wide, with two chrominance samples in the top row of the sampling block, and zero chrominance samples in the bottom row of the sampling block. Frequently, it is necessary to convert between different YUV color space formats to satisfy requirements for a particular hardware or software component. For example, a hardware component (e.g., a camera or a display) can produce an image frame in one YUV color space format, and another component (e.g., a hardware component or a software component) can require the image frame in another YUV color space format.

Generally, current image and/or video processing systems convert an image frame from one YUV color space format to another YUV color space format using a central processing unit (CPU). However, converting an image frame from one YUV color space format to another YUV color space format in the CPU can constrain system bandwidth and be inefficient. Alternatively, certain image and/or video processing systems convert an image frame from one YUV color space format to another YUV color space format using a graphic processing unit (GPU). In this scenario, the GPU converts an image frame from a YUV color space format to a RGB color space format. Then, the image frame in the RGB color space format is converted back into a different YUV color space format using the GPU. However, this solution requires an extra conversion (e.g., an extra copy to a different color space format) that constrains system bandwidth and extends processing time.

SUMMARY

The following presents a simplified summary of the specification in order to provide a basic understanding of some aspects of the specification. This summary is not an extensive overview of the specification. It is intended to neither identify key or critical elements of the specification, nor delineate any scope of the particular implementations of the specification or any scope of the claims. Its sole purpose is to present some concepts of the specification in a simplified form as a prelude to the more detailed description that is presented later.

In accordance with an implementation, a system converts a source image frame in a particular YUV format to another YUV format. The system can include a texture component, a luminance component and a chrominance component. The texture component can generate one or more luminance input pixels and one or more chrominance input pixels from a source image. The one or more luminance input pixels can each include a luma component; the one or more chrominance input pixels can each include a first chroma component and a second chroma component. The luminance component can generate one or more luminance output pixels. The one or more luminance output pixels can each include a group of luminance input pixels. The chrominance component can generate one or more chrominance output pixels. The one or more chrominance output pixels can each include a group of first chroma components or a group of second chroma components.

Additionally, a non-limiting implementation provides for generating one or more luminance input pixels from a source image, for generating one or more chrominance input pixels from the source image, for generating one or more luminance output pixels, and for generating one or more chrominance output pixels. The one or more luminance input pixels can each include a luma component and the one or more chrominance input pixels can each include a first chroma component and a second chroma component. Additionally, the one or more luminance output pixels can each include a group of luminance input pixels and the one or more chrominance output pixels can each include a group of first chroma components or a group of second chroma components.

Furthermore, a non-limiting implementation provides for receiving a source image in first color space format from a central processing unit (CPU), for generating a first input buffer with luminance graphic data from the source image, and for generating a second input buffer with chrominance graphic data from the source image. Additionally, the non-limiting implementation provides for generating output pixel values of the luminance graphic data in a second color space format, for generating output pixel values of the chrominance graphic data in the second color space format, and for sending the output pixel values of the luminance graphic data in the second color space format and the output pixel values of the chrominance graphic data in the second color space format to the CPU.

The following description and the annexed drawings set forth certain illustrative aspects of the specification. These aspects are indicative, however, of but a few of the various ways in which the principles of the specification may be employed. Other advantages and novel features of the specification will become apparent from the following detailed description of the specification when considered in conjunction with the drawings.

BRIEF DESCRIPTION OF THE DRAWINGS

Numerous aspects, implementations, objects and advantages of the present invention will be apparent upon consideration of the following detailed description, taken in conjunction with the accompanying drawings, in which like reference characters refer to like parts throughout, and in which.

DETAILED DESCRIPTION

Figure 1:
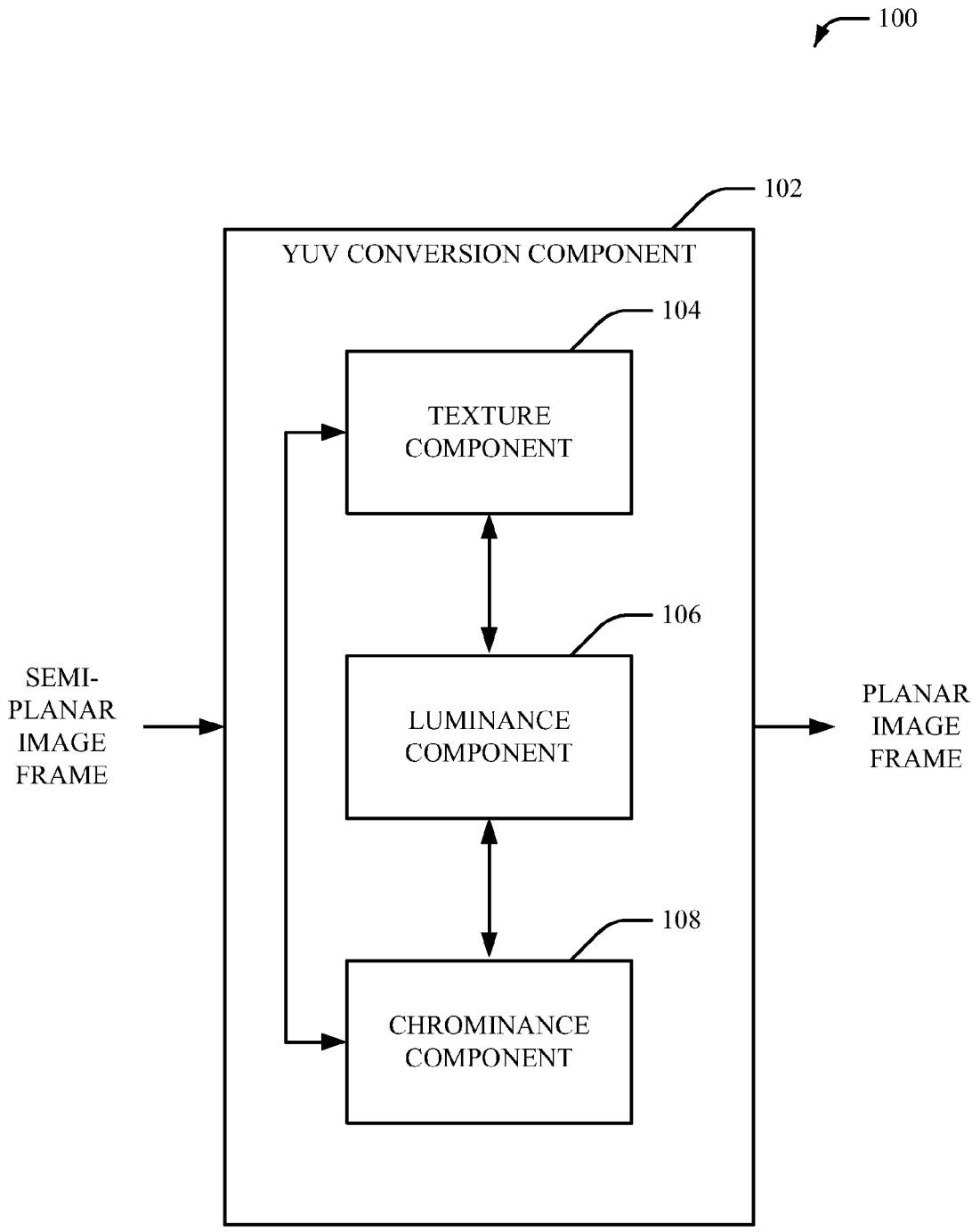
FIG. 1 illustrates a block diagram of an example system that can convert an image frame between semi-planar YUV and planar YUV color space formats, in accordance with various aspects and implementations described herein.

Various aspects of this disclosure are now described with reference to the drawings, wherein like reference numerals are used to refer to like elements throughout. In the following description, for purposes of explanation, numerous specific details are set forth in order to provide a thorough understanding of one or more aspects. It should be understood, however, that certain aspects of this disclosure may be practiced without these specific details, or with other methods, components, materials, etc. In other instances, well-known structures and devices are shown in block diagram form to facilitate describing one or more aspects.

Various components in a computer device can be configured to processes image and/or video frames (e.g., graphic data). However, a computer device (e.g., a mobile device) can include a hardware component (e.g., a camera or a display) that produces an image frame (e.g., a video frame) in one YUV color space format, and another component (e.g., a hardware component or a software component) that requires the image frame be in another YUV color space format. Therefore, the computer device can be configured to convert between different YUV color space formats to satisfy requirements of various components on the computer device. For example, camera frame data (e.g., a source image) can be delivered from a memory (e.g., a buffer). The source image can be delivered in a particular YUV color space format at a certain resolution (e.g., a resolution implemented by a camera preview mode). The source image can also be delivered in a natural orientation of the camera (e.g., a landscape orientation or a portrait orientation). However, another component (e.g., an encoder) may require a source image in a different YUV color space format, size, and/or orientation.

Systems and methods disclosed herein relate to converting between different YUV color space formats using circuitry and/or instructions stored or transmitted in a computer readable medium in order to provide improved processing speed, processing time, memory bandwidth, image quality and/or system efficiency. Direct conversion between different YUV color space formats can be implemented by separately converting luminance (e.g., luma) and chrominance (e.g., chroma) components of an image frame. Additionally, the image frame can be scaled and/or rotated. Therefore, processing time to convert between different YUV formats color space can be reduced. As such, the data rate required to achieve desired output quality can be reduced. Additionally, the amount of memory bandwidth to convert between different YUV color space formats can be improved.

Referring initially to FIG. 1, there is illustrated an example system 100 that can convert an image frame (e.g., a video frame) from one YUV color space format to another YUV color space format, according to an aspect of the subject disclosure. For example, the system 100 can convert an image frame from one YUV color space format directly to another YUV color space format in a graphic processing unit (GPU). Specifically, the system 100 can provide a luminance conversion feature and a chrominance conversion feature to convert a semi-planar image frame to a planar image frame (or convert a planar image frame to a semi-planar image frame). The system 100 can be employed by various systems, such as, but not limited to, image and video capturing systems, media player systems, televisions, cellular phones, tablets, personal data assistants, gaming systems, computing devices, and the like.

In particular, the system 100 can include a YUV conversion component 102. The YUV conversion component 102 can include a texture component 104, a luminance (e.g., luma) component 106 and a chrominance (e.g., chroma) component 108. The YUV conversion component 102 can receive a semi-planar image frame (e.g., a source image) in a particular color space format. The semi-planar image frame can include a plane (e.g., a group) of luminance (Y) data, followed by a plane (e.g., a group) of chrominance (UV) data. For example, the semi-planar image frame can be configured in a NV21 (e.g., YUV 4:2:0 semi-planar) color space format, where the image frame includes one plane of Y luminance data and one plane of interleaved V chrominance data and U chrominance data. In another example, the semi-planar image frame can be configured in a NV12 (e.g., YUV 4:2:0 semi-planar) color space format, where the image frame includes one plane of Y luminance data and one plane of interleaved U chrominance data and V chrominance data. However, it is to be appreciated that the semi-planar image frame can be implemented in other YUV formats, such as, but not limited to, a YUV 4:1:1 semi-planar format, a YUV 4:2:2 semi-planar format, or a YUV 4:4:4 semi-planar format.

The YUV conversion component 102 can transform the semi-planar image frame into a planar image frame. For example, the YUV conversion component 102 can generate a planar output buffer with planar image frame data from a semi-planar input buffer with semi-planar image frame data. The planar image frame can include a plane of luminance (Y)

data, followed by a plane of chrominance (U) data and a plane of chrominance (V) data (or a plane of chrominance (V) data and a plane of chrominance (U) data). For example, the planar image frame can be configured in a I420 (e.g., YUV 4:2:0) color space format, where the image frame includes one plane of Y luminance data, a plane of U chrominance data, and a plane of V chrominance data. In one example, the YUV conversion component 102 can be implemented in a GPU. Thereafter, the YUV conversion component 102 can send the planar image frame to a central processing unit (CPU) and/or an encoder. However it is to be appreciated that the YUV conversion component 102 can also be implemented in the CPU and/or the encoder.

Transformation of an image frame from a semi-planar image format into a planar image frame format can be implemented by separately transforming a luminance (Y) data channel and chrominance (U/V) data channels. For example, the YUV conversion component 102 can receive interleaved U/V chrominance data and generate separate planes of U and V chrominance data. In one example, a semi-planar 320×240 image frame can be transformed into a planar 200×320 image frame. The planar 200×320 image frame can also be rotated, cropped and/or scaled. In another example, a luminance (Y) channel of a semi-planar 320×240 image frame can be transformed into a planar 200×320 image frame and an interleaved chrominance (V/U) semi-planar 160×120 image frame can be transformed into a planar 100×160 image frame with separate U and V planes. The planar 200×320 image frame and the planar 100×160 image frame can also be rotated, cropped and/or scaled. Therefore, the luminance (Y) channel and the chrominance (UN) data channels of an image frame can be at different resolutions (e.g., aspect ratios). In one example, the chrominance (U/V) data channels can be full resolution data (e.g., non-subsampled data). Therefore, the chrominance (UN) data channels can include data chrominance data that is not sub-sampled.

The texture component 104 can be configured to generate one or more luminance (e.g., luma) input pixels and one or more chrominance (e.g., chroma) input pixels from a source image. The one or more luminance input pixels can each include a luma component (e.g., Y component) and the one or more chrominance input pixels can each include a first chroma component and a second chroma component (e.g., a U component or a V component). The luminance component 106 can be configured to generate one or more luminance output pixels. The one or more luminance output pixels can each include a group of luminance input pixels. The chrominance component 108 can be configured to generate one or more chrominance output pixels. The one or more chrominance output pixels can each include a group of first chroma components or a group of second chroma components. Therefore, the system 100 can be configured to convert the image frame in a first color space format (e.g., a semi-planar image frame format) to a second color space format (e.g., a planar image frame format). In one example, the luminance component 106 and/or the chrominance component 108 can be implemented using a shader (e.g., a computer program) to calculate (e.g., transform) graphic data (e.g., luminance and/or chrominance data). For example, the shader can be implemented as a pixel shader and/or a vertex shader.

While FIG. 1 depicts separate components in system 100, it is to be appreciated that the components may be implemented in a common component. For example, the texture component 104, the luminance component 106 and/or the chrominance component 108 can be implemented in a single component. Further, it can be appreciated that the design of system 100 can include other component selections, component placements, etc., to combine two or more primary predictors derived from the same or from different reference frames.

Figure 2:
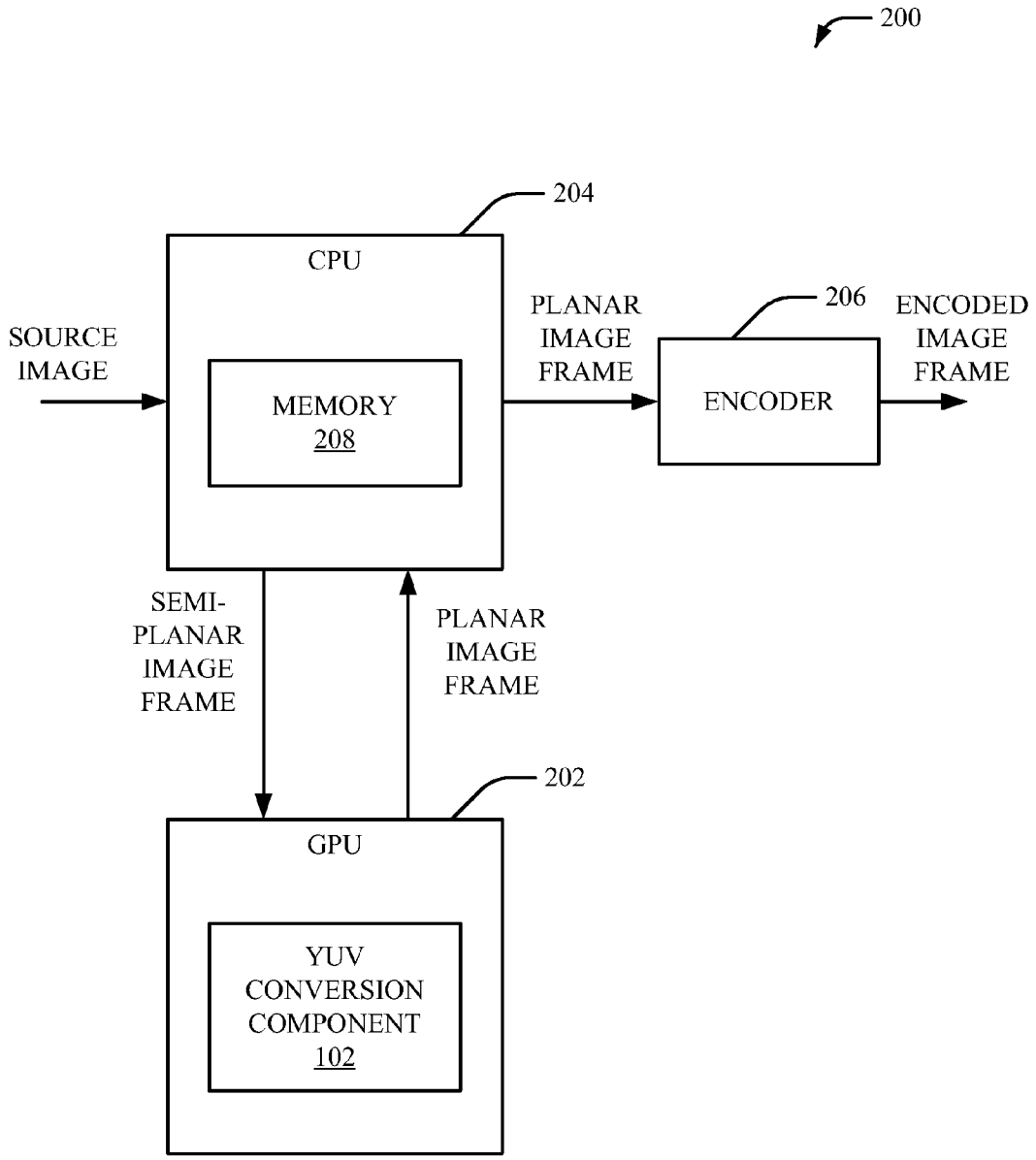
FIG. 2 illustrates a system with a YUV conversion component, in accordance with various aspects and implementations described herein.

Referring to FIG. 2, there is illustrated a system 200 with a YUV conversion component, according to an aspect of the subject disclosure. The system 200 can include a GPU 202, a CPU 204 and an encoder 206. The GPU 202 can include the YUV conversion component 102 and the CPU 204 can include a memory 208.

The CPU 204 can send graphic data from a source image in a first format (e.g., semi-planar image frame format) to the YUV conversion component 102 in the GPU 202. The YUV conversion component 102 can separate (e.g., and/or store) the semi-planar image frame data into luminance data and chrominance data. For example, the YUV conversion component 102 can separate the semi-planar image frame data into luminance data and chrominance data via textures (e.g., using one or more buffers to store graphic data). The luminance data and the chrominance data from the source image can be at different resolutions (e.g., a luminance plane can be formatted as 320×240 and a chrominance plane can be formatted as 160×120.). In one example, the luminance data and/or the chrominance data from the source image are sub-sampled data. In another example, the luminance data and/or the chrominance data from the source image are non-sub-sampled data. The YUV conversion component 102 can then separately transform the luminance semi-planar image frame data and the chrominance semi-planar image frame data into planar image frame data. For example, the YUV conversion component 102 can separately transform the luminance semi-planar image frame data and the chrominance semi-planar image frame data using a shader. The transformed planar image frame data can be presented and/or stored in the memory 208 located in the CPU 204. Additionally, the CPU 204 can present the planar image frame to the encoder 206 to encode the planar image frame. Accordingly, the GPU 202 can directly convert a semi-planar image frame into a planar image frame in two steps (e.g., a step to convert luminance (Y) data and a step to convert chrominance (UV) data). As such, the source image can be configured in a first color space format (e.g., as a semi-planar image frame), and the GPU 202 can generate an image frame in a second color space format (e.g., as a planar image frame).

Figure 3:
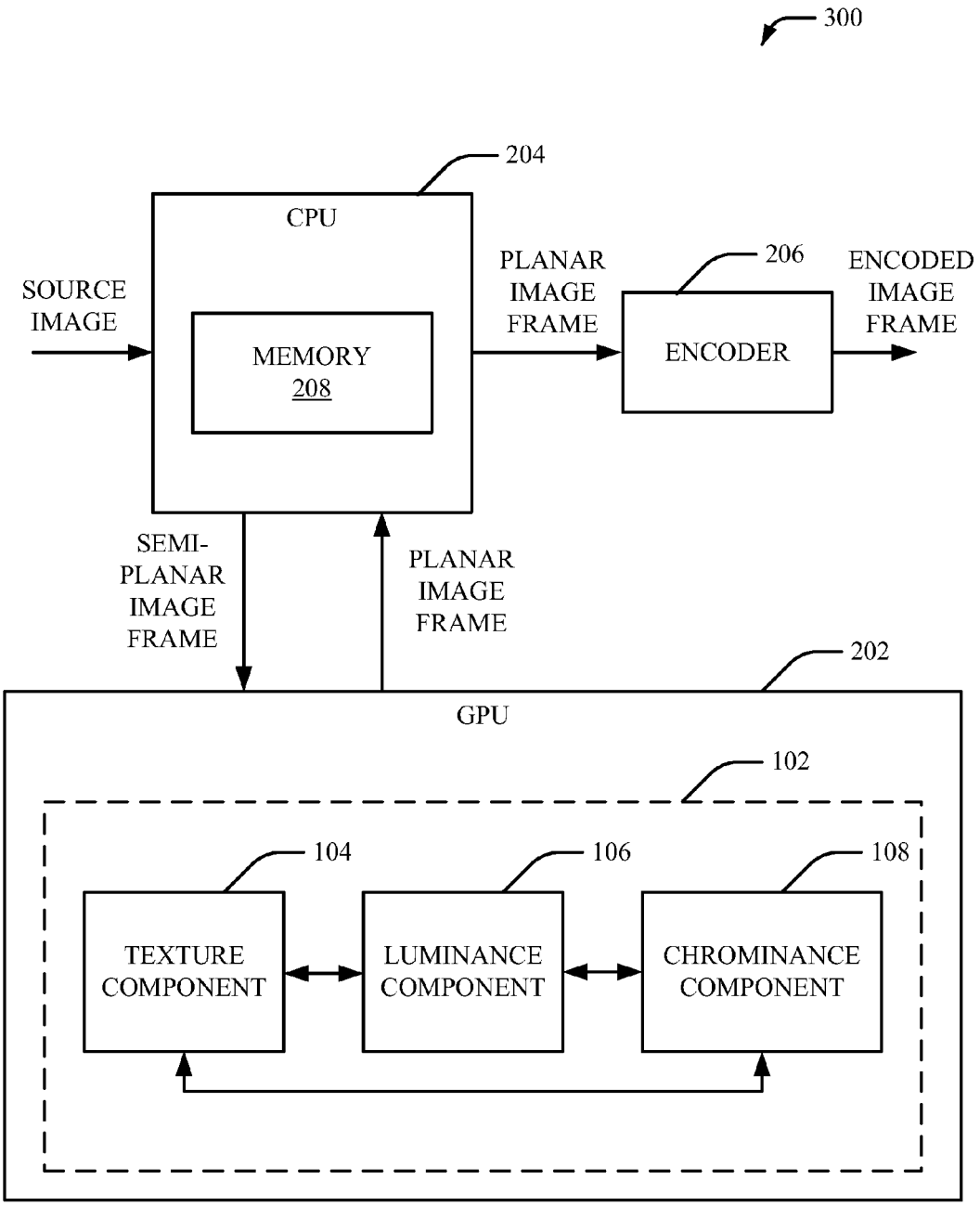
FIG. 3 illustrates a system with a texture component, a luminance component and a chrominance component, in accordance with various aspects and implementations described herein.

Referring to FIG. 3, there is illustrated a system 300 with a texture component, a luminance component and a chrominance component, according to an aspect of the subject disclosure. The system 300 can include the GPU 202, the CPU 204 and the encoder 206. The GPU 202 can include the YUV conversion component 102. The YUV conversion component 102 can include the texture component 104, the luminance component 106 and the chrominance component 108. The texture component 104 can separate (e.g., and/or store) the semi-planar image frame data into luminance data and chrominance data. For example, the texture component 104 can separate the semi-planar image frame data into luminance data and chrominance data via textures. As such, the texture component 104 can be implemented as one or more input buffers (e.g., an input buffer for luminance data and/or an input buffer for chrominance data).

The luminance component 106 can transform the luminance semi-planar image frame data into luminance planar image frame data. Additionally, the chrominance component 108 can transform the chrominance semi-planar image frame data into chrominance planar image frame data. The luminance planar image frame data and/or the chrominance planar image frame data can be stored in one or more output buffers (e.g., an output buffer for luminance planar image frame data and/or an output buffer for chrominance planar image frame data). The transformed luminance planar image frame data and/or the chrominance planar image frame data can be presented and/or stored in the memory 208 in the CPU 204. Accordingly, the GPU 202 can directly convert the luminance semi-planar image frame data into luminance planar frame data, and the chrominance semi-planar image frame data into chrominance planar frame data. As such, the source image and/or the texture component 104 can be configured in a first color space format (e.g., as a semi-planar image frame), and the luminance component 106 and/or the chrominance component 108 can be configured in a second color space format (e.g., as a planar image frame).

Figure 4:
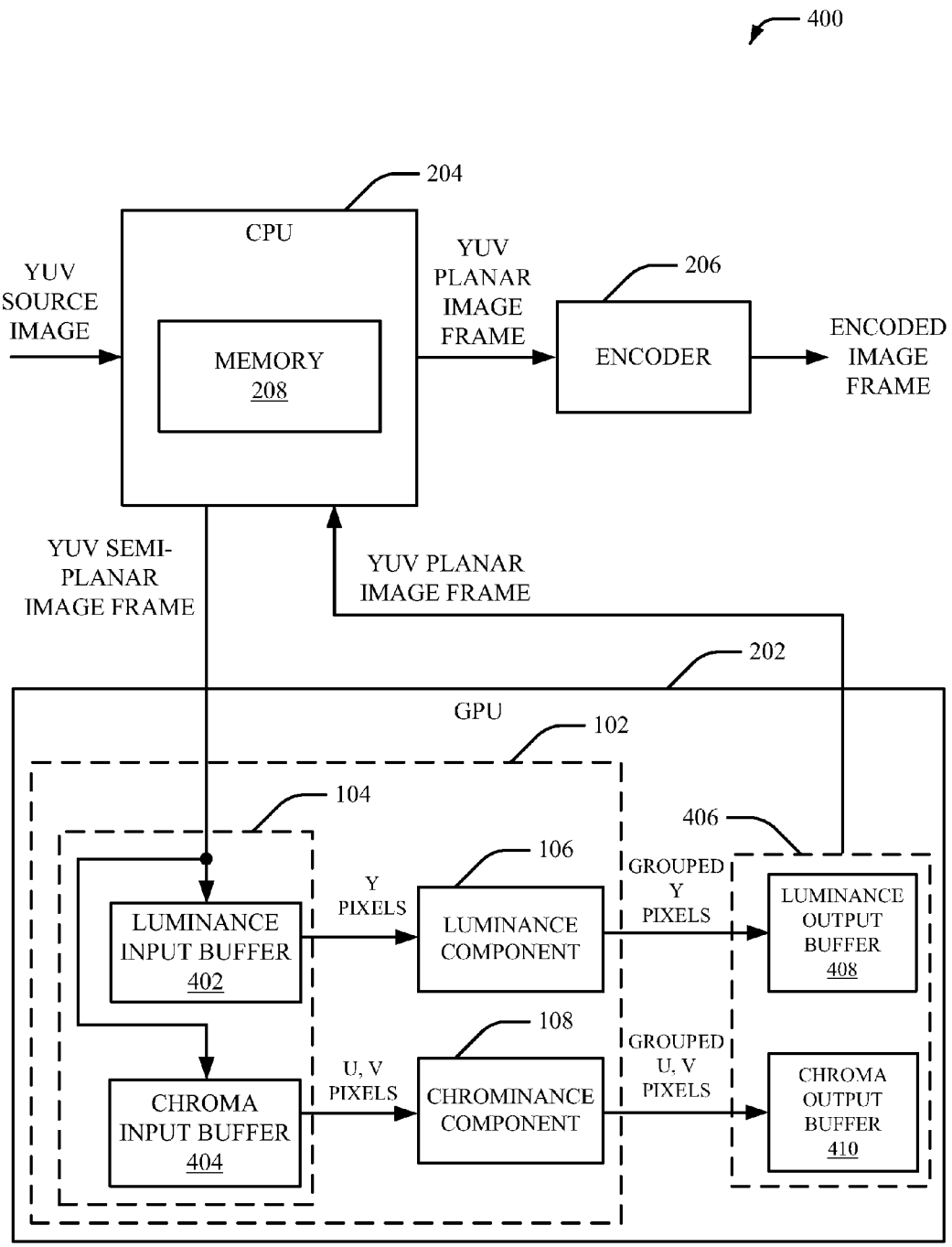
FIG. 4 illustrates a YUV conversion system with one or more input buffers and one or more output buffers, in accordance with various aspects and implementations described herein.

Referring now to FIG. 4, there is illustrated a non-limiting implementation of a system 400 with one or more input buffers and one or more output buffers in accordance with this disclosure. The system 400 can include the GPU 202, the CPU 204 and the encoder 206. The GPU 202 can include the YUV conversion component 102 and an output buffer 406. The texture component 104 in the YUV conversion component 102 can include a luminance input buffer 402 and a chroma input buffer 404. The luminance input buffer 402 can store data from the luminance (Y) channel of the YUV semi-planar image frame (e.g., to transform the YUV semi-planar image frame into a planar image frame). The chroma input buffer 404 can store the chrominance (UN) channels of the YUV semi-planar image frame (e.g., to transform the YUV semi-planar image frame into a planar image frame). Therefore the luminance (Y) channel and the chrominance (UN) channels of the YUV semi-planar image frame can be stored separately (e.g., to be transformed in different steps). In one example, the luminance input buffer 402 and/or the chroma input buffer 404 can be stored or formed as textures. For example, the luminance input buffer 402 can be stored or formed as a luminance (Y) input texture. Similarly, the chroma input buffer 404 can be stored or formed as a chrominance (UN) input texture.

The luminance input buffer 402 can include one component (e.g., one Y component) per pixel. The chroma input buffer 404 can include two input components (e.g., a U component and a V component) per pixel. The size of the luminance input buffer 402 and/or the chroma input buffer 404 can depend on the size of the source image. For example, the luminance input buffer size and the source image size can be a 1:1 ratio. In one example, the luminance input buffer 402 can be an 8×3 buffer to store luminance data for an 8×3 source image. The chroma input buffer size and the source image size can be a 1:2 ratio when the chroma data is subsampled. In one example, the chroma input buffer 404 can be an 8×4 buffer to store chrominance data for a 16×8 source image.

The output buffer 406 can include a luminance output buffer 408 and a chroma output buffer 410. The luminance output buffer 408 can include output pixel values of the luminance component from the luminance input buffer 402 (e.g., luminance graphic data). For example, the luminance output buffer 408 can include a group of luminance pixels from the luminance input buffer 402 (e.g., each output pixel in the luminance output buffer 408 can represent a group of Y source pixels from the luminance input buffer 402). The chroma output buffer 410 can include output pixel values of the chroma components from the chroma input buffer 404 (e.g., chrominance graphic data). For example, the chroma output buffer 410 can include a group of U chrominance pixels or a group of V chrominance pixels from the chroma input buffer 404 (e.g., each output pixel in the chroma output buffer 410 can represent a group of U source pixels or a group of V source pixels from the chroma input buffer 404).

In one example, the top half of the chroma output buffer 410 can include U data and the bottom half of the chroma output buffer 410 can include V data. In another example, the top half of the chroma output buffer 410 can include V data and the bottom half of the chroma output buffer 410 can include U data. Therefore, the luminance output buffer 408 can store image frame data that has been transformed by the luminance component 106 and the chroma output buffer 410 can store image frame data that has been transformed by the chrominance component 108. As such, the source image, the luminance input buffer 402 and/or the chroma input buffer 404 can be configured in a first color space format (e.g., as a semi-planar image frame), and the luminance component 106, the chrominance component 108, the luminance output buffer 408 and/or the chroma output buffer 410 can be configured in a second color space format (e.g., as a planar image frame).

The luminance input buffer 402, the chroma input buffer 404 and/or the output buffer 406 (e.g., the luminance output buffer 408 and/or the chroma output buffer 410) can be any form of volatile and/or non-volatile memory. For example, the buffer 304 can include, but is not limited to, magnetic storage devices, optical storage devices, smart cards, flash memory (e.g., single-level cell flash memory, multi-level cell flash memory), random-access memory (RAM), read-only memory (ROM), programmable read-only memory (PROM), erasable programmable read-only memory (EPROM), electrically erasable programmable read-only memory (EEPROM), or non-volatile random-access memory (NVRAM) (e.g., ferroelectric random-access memory (FeRAM)), or a combination thereof. Further, a flash memory can comprise NOR flash memory and/or NAND flash memory.

Figure 5:
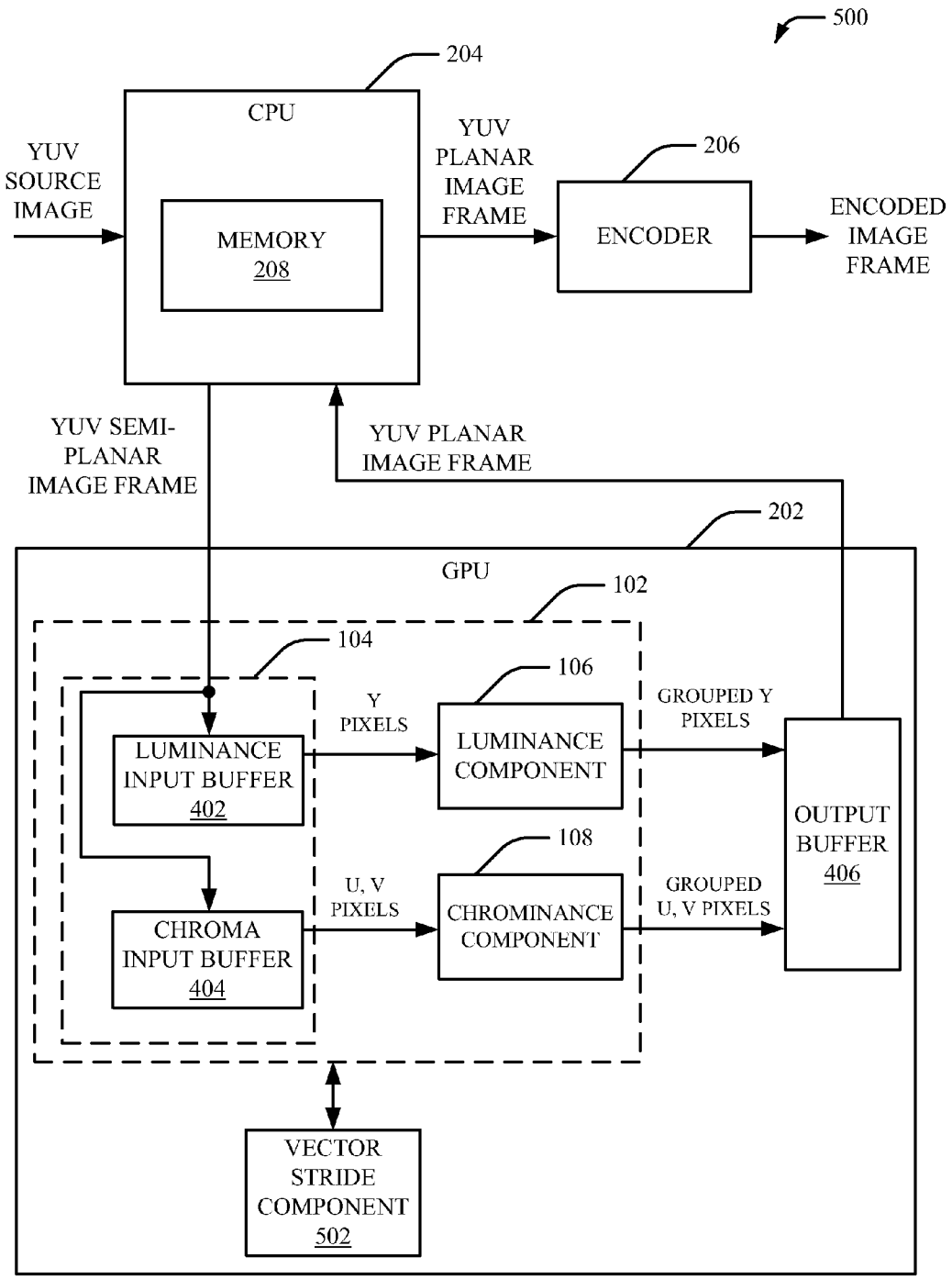
FIG. 5 illustrates a YUV conversion system with a vector stride component, in accordance with various aspects and implementations described herein.

Referring now to FIG. 5, there is illustrated a non-limiting implementation of a system 500 with a vector stride component in accordance with this disclosure. The system 500 can include the GPU 202, the CPU 204 and the encoder 206. The GPU 202 can include the YUV conversion component 102, the output buffer 406 and a vector stride component 502. The vector stride component 502 can implement a vector stride. Accordingly, the vector stride component 502 can indicate spacing between source pixels to be sampled. For example, the vector stride component 502 can be configured to generate a vector to indicate spacing between one or more luminance pixels and/or one or more chrominance pixels in a source image (e.g., spacing between one or more luminance input pixels and/or one or more chrominance input pixels). In one example, a vector stride can be implemented by the vector stride component 502 when implementing a shader to transform between an unpacked pixel data format (e.g., a format where input luminance data includes one or more grayscale components or a format where input semi-planar chrominance data includes one or more pixels with a pair of chrominance components) to a packed pixel data format (e.g., a format that groups multiple components into a single pixel). For example, the packed pixel data format can include a format that groups four luminance components into a pixel with RGBA components. The vector stride component 502 can implement a vector stride in a system with a GPU that restricts possible formats of frame buffer objects.

If no rotation is being applied, the vector stride component 502 can present a vector between one source pixel and the next pixel to the right. For example, the vector stride component 502 can present a vector to an adjacent pixel on a right side of a particular input pixel of a source image if no rotation is performed on the luminance output buffer 408 and/or the chroma output buffer 410 (e.g., one or more luminance output pixels and/or one or more chrominance output pixels). If the image is to be rotated 90 degrees clockwise, the vector stride component 502 can present a vector to the next pixel below. For example, the vector stride component 502 can present a vector to an adjacent pixel below a particular pixel of a source image if a 90 degrees clockwise rotation is performed on the luminance output buffer 408 and/or the chroma output buffer 410 (e.g., one or more luminance output pixels and/or one or more chrominance output pixels). In one example, for an 8×3 source image, the stride vector can be set to ⅛,0.

In an example pseudo-code, a stride vector can be implemented as follows:

```
float y1, y2, y3, y4;
y1=texture2D(s_texture, v_texCoord).r;
y2=texture2D(s_texture, v_texCoord+vec2(1.0*pix_stride.x, 1.0*pix_stride.y)).r;
y3=texture2D(s_texture, v_texCoord+vec2(2.0*pix_stride.x, 2.0*pix_stride.y)).r;
y4=texture2D(s_texture, v_texCoord+vec2(3.0*pix_stride.x, 3.0*pix_stride.y)).r;
gl_FragColor=vec4(y1, y2, y3, y4);
```

Figure 6:
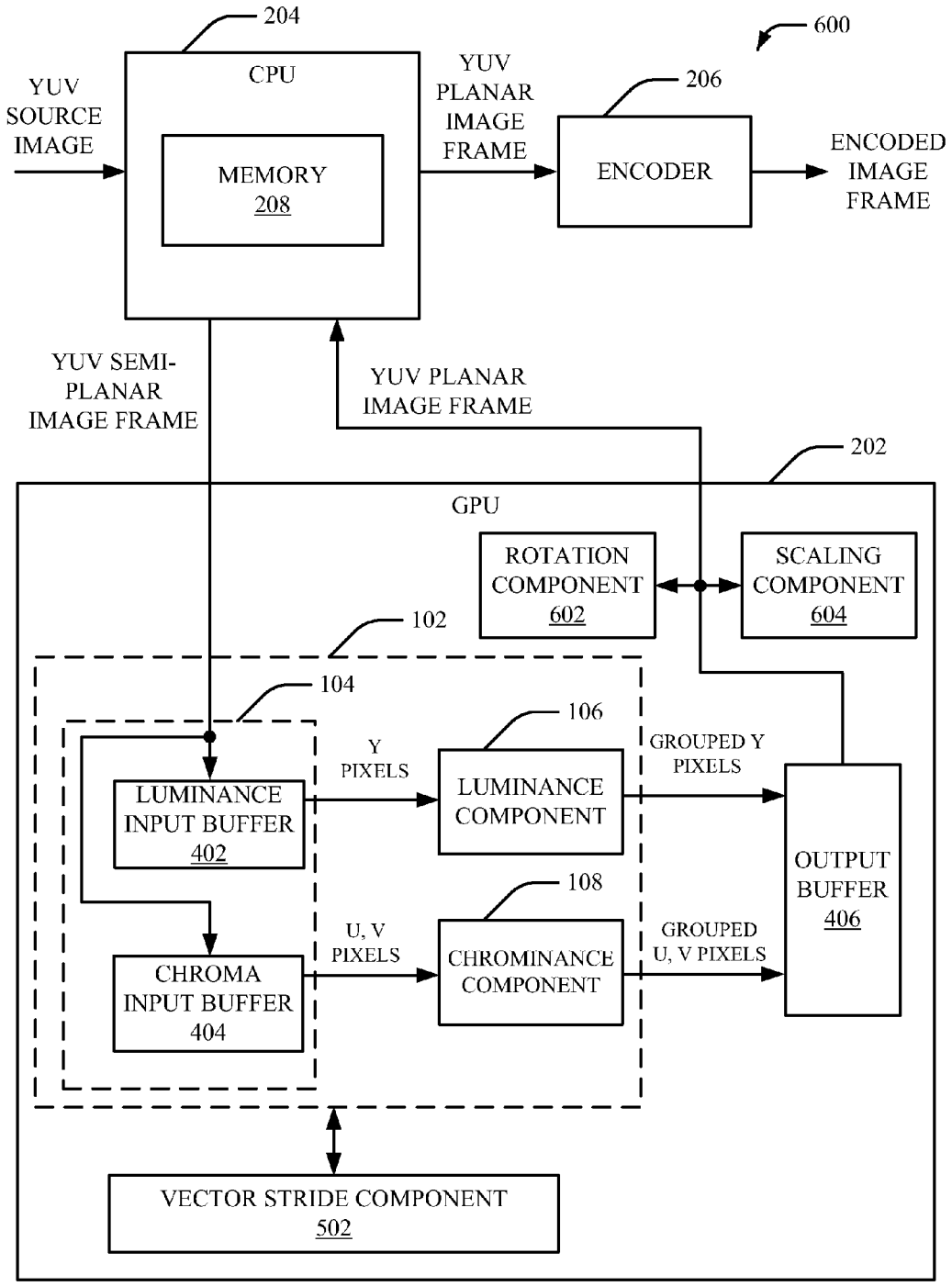
FIG. 6 illustrates a YUV conversion system with a rotation component and a scaling component, in accordance with various aspects and implementations described herein.

Referring now to FIG. 6, there is illustrated a non-limiting implementation of a system 600 with a rotation component and a scaling component in accordance with this disclosure. The system 600 can include the GPU 202, the CPU 204 and the encoder 206. The GPU 202 can include the YUV conversion component 102, the output buffer 406 (which can include the luminance output buffer 408 (not shown) and the chroma output buffer 410 (not shown)), the vector stride component 502, a rotation component 602 and a scaling component 604. The rotation component 602 can be configured to rotate pixels in the luminance output buffer 408 and/or the chroma output buffer 410 (e.g., one or more luminance output pixels and/or one or more chrominance output pixels). The rotation component 602 can implement a vertex shader to rotate coordinates of the pixels in the luminance output buffer 408 and/or the chroma output buffer 410 (e.g., rotate an image frame). For example, if the image is rotated 90 degrees, then a vertex shader can rotate coordinates of the source image so that when an output pixel is on the top left, the source texture coordinates will point to the bottom left (to be described in more detail in FIG. 10). In one example, the rotation component 602 can be configured to rotate an image frame if a device orientation does not match a camera orientation.

The scaling component 604 can be configured to scale the image frame. For example, the scaling component 604 can be configured to resize pixels in the luminance output buffer 408 and/or the chroma output buffer 410 (e.g., one or more luminance output pixels and/or one or more chrominance output pixels). In one example, the scaling component 604 can scale an image frame if a preview resolution on a camera does not match a resolution of an encoder. The scaling component 604 can also be configured to clip pixels in the luminance output buffer 408 and/or the chroma output buffer 410 (e.g., clip an image frame). Rather than constricting input source texture vertices, a clip transformation can be implemented in the calculation of wrapped vertices. Therefore, a calculation for a scaled image can be implemented as follows:

$$\text{realSrc}X=\text{clip}X+\text{scale}X*(1-2*\text{clip}X)*(\text{rotatedSrc}X-\text{bias}X)$$

$$\text{realSrc}Y=\text{clip}Y+\text{scale}Y*(1-2*\text{clip}Y)*(\text{rotatedSrc}Y-\text{bias}Y)$$

Figure 7:
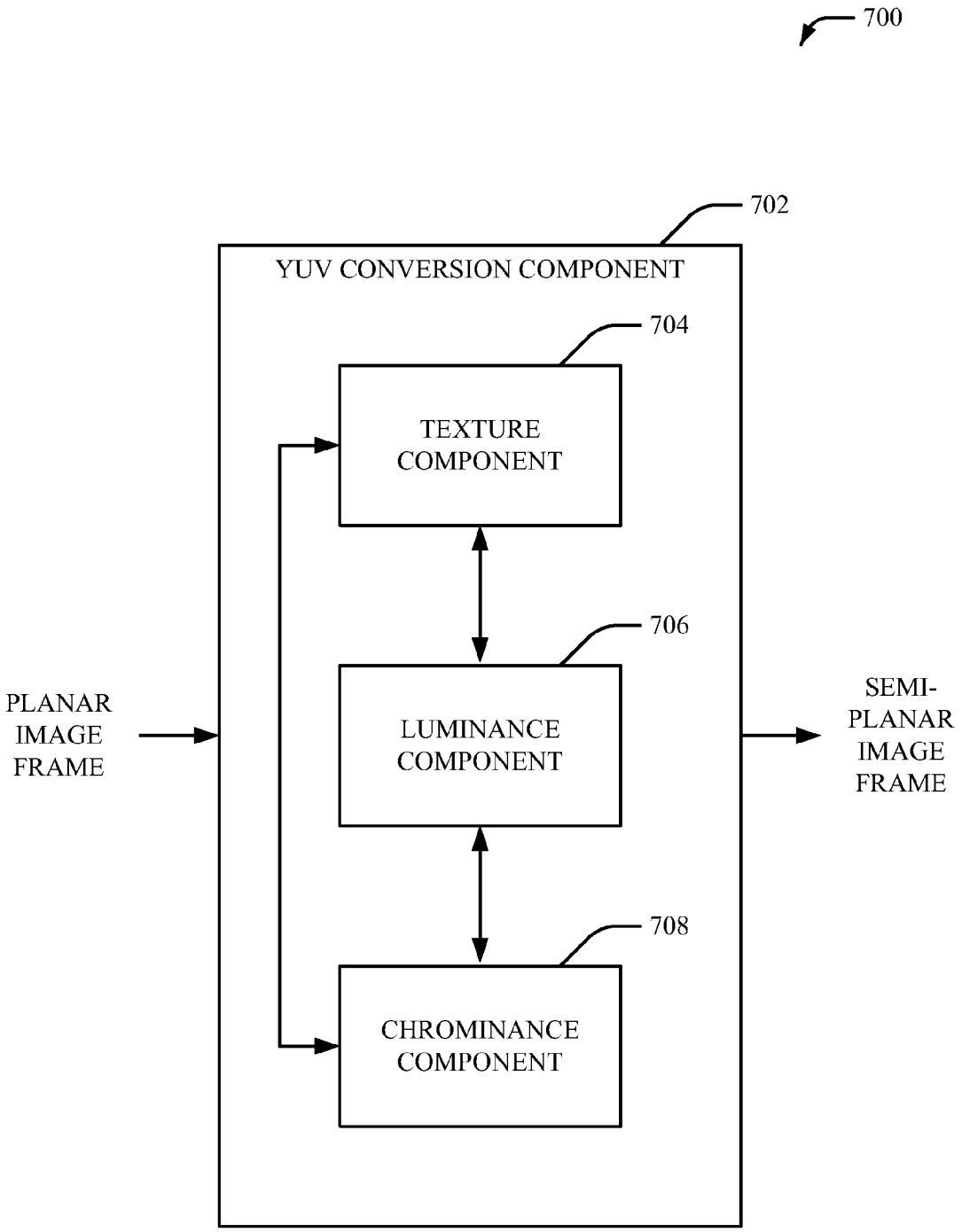
FIG. 7 illustrates another block diagram of an example system that can convert an image frame between planar YUV and semi-planar YUV color space formats, in accordance with various aspects and implementations described herein.

Referring now to FIG. 7, there is illustrated a non-limiting implementation of a system 700 that can convert an image frame between planar YUV and semi-planar YUV color space formats in accordance with this disclosure. The system 700 can include a YUV conversion component 702. Similar to the YUV conversion component 102, the YUV conversion component 702 can include a texture component 704, a luminance (e.g., luma) component 706 and a chrominance (e.g., chroma) component 708. However, the YUV conversion component 702 can convert a planar image frame into a semi-planar image frame by separately converting luminance image frame information and chrominance image frame information.

Accordingly, the YUV conversion component 702 can receive a planar image frame (e.g., a source image) in a particular color space format. The planar image frame can include a plane of luminance (Y) data, followed by a plane of chrominance (U) data and a plane of chrominance (V) data (or a plane of chrominance (V) data and a plane of chrominance (U) data). For example, the YUV conversion component 702 can receive a planar image frame in a particular color space format. For example, the planar image frame can be configured in a I420 (e.g., YUV 4:2:0) color space format, where the image frame includes one plane of Y luminance data, a plane of U chrominance data, and a plane of V chrominance data.

The YUV conversion component 702 can transform the planar image frame into a semi-planar image frame. The semi-planar image frame can include a plane (e.g., a group) of luminance (Y) data, followed by a plane (e.g., a group) of chrominance (UV) data. For example, the generated semi-planar image frame can be configured in a NV21 (e.g., YUV 4:2:0 semi-planar) color space format, where the image frame includes one plane of Y luminance data and one plane of interleaved V chrominance data and U chrominance data. In another example, the generated semi-planar image frame can be configured in a NV12 (e.g., YUV 4:2:0 semi-planar) color space format, where the image frame includes one plane of Y luminance data and one plane of interleaved U chrominance data and V chrominance data. However, it is to be appreciated that the generated semi-planar image frame can be implemented in other YUV formats, such as, but not limited to, a YUV 4:1:1 semi-planar format, a YUV 4:2:2 semi-planar format, or a YUV 4:4:4 semi-planar format.

The texture component 704 can be configured to generate one or more luminance (e.g., luma) input pixels and one or more chrominance (e.g., chroma) input pixels from a source image. The one or more luminance input pixels can each include a luma component (e.g., Y component) and the one or more chrominance input pixels can each include a first chroma component and a second chroma component (e.g., a U component and a V component). The luminance component 706 can be configured to generate one or more luminance output pixels. The one or more luminance output pixels can each include a group of luminance input pixels. The chrominance component 708 can be configured to generate one or more chrominance output pixels. The one or more chrominance output pixels can include a group of first chroma components and a group of second chroma components.

In one example, the YUV conversion component 702 can be implemented in a GPU (e.g., the GPU 202). However it is to be appreciated that the YUV conversion component 102 can also be implemented in a CPU (e.g., the CPU 204). The YUV conversion component 702 can send the semi-planar image frame to the CPU 204 and/or the encoder 206. Therefore, the system 700 can be configured to convert the image frame in a first color space format (e.g., a planar image frame format) to a second color space format (e.g., a semi-planar image frame format). In one example, the luminance component 706 and/or the chrominance component 708 can be implemented using a shader (e.g., a computer program) to calculate (e.g., transform) the graphic data (e.g., luminance and/or chrominance data).

While FIG. 7 depicts separate components in system 700, it is to be appreciated that the components may be implemented in a common component. For example, the texture component 704, the luminance component 706 and/or the chrominance component 708 can be implemented in a single component. Further, it can be appreciated that the design of system 700 can include other component selections, component placements, etc., to combine two or more primary predictors derived from the same or from different reference frames.

Figure 8:
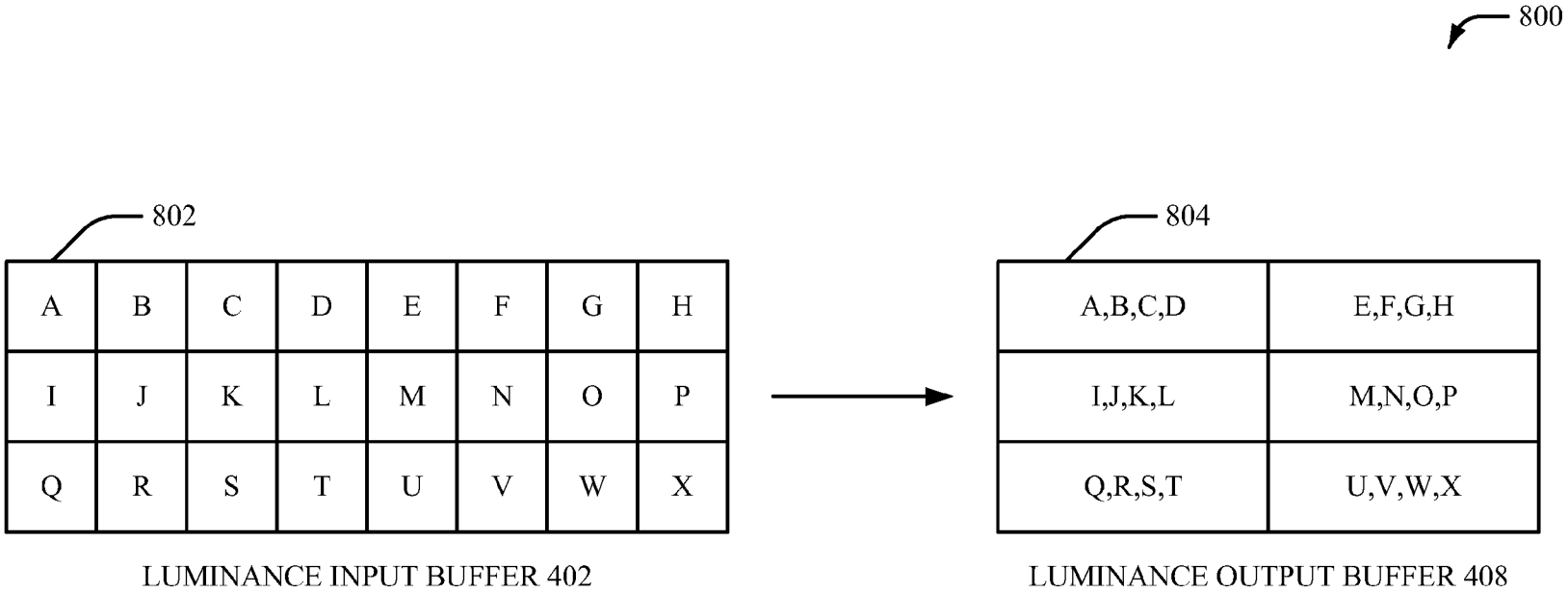
FIG. 8 illustrates a non-limiting implementation for transforming a luminance input buffer into a luminance output buffer, in accordance with various aspects and implementations described herein.

Referring now to FIG. 8, there is illustrated a non-limiting implementation of a system 800 for transforming a luminance input buffer into a luminance output buffer in accordance with this disclosure. Semi-planar image frame data (e.g., luminance data) stored in the luminance input buffer 402 can be transformed and stored as planar image frame data (e.g., luminance data) in the luminance output buffer 408. In the example shown in FIG. 8, the luminance input buffer 402 is formed in response to data received from an 8×3 source image. The luminance input buffer 402 can include one or more pixels (e.g., pixels A-X shown in FIG. 8). For example, a pixel 802 includes a luminance component (e.g., a pixel) A. The size of the luminance input buffer 402 can correspond to the size of the source image. Therefore, the luminance input buffer 402 shown in FIG. 8 is an 8×3 buffer. The luminance output buffer 408 can group the pixels from the luminance input buffer 402. For example, an output pixel 804 can include pixels A, B, C and D (e.g., four pixels). As such, the luminance output buffer 408 can be smaller than the luminance input buffer 402. For example, the luminance output buffer 408 shown in FIG. 8 is a 2×3 buffer. In one example, a stride vector for the 8×3 source image can be set to ⅛, 0. It is to be appreciated that the size of the luminance input buffer 402 and/or the luminance output buffer 408 can be varied to meet the design criteria of a particular implementation (e.g., a particular YUV format).

Figure 9:
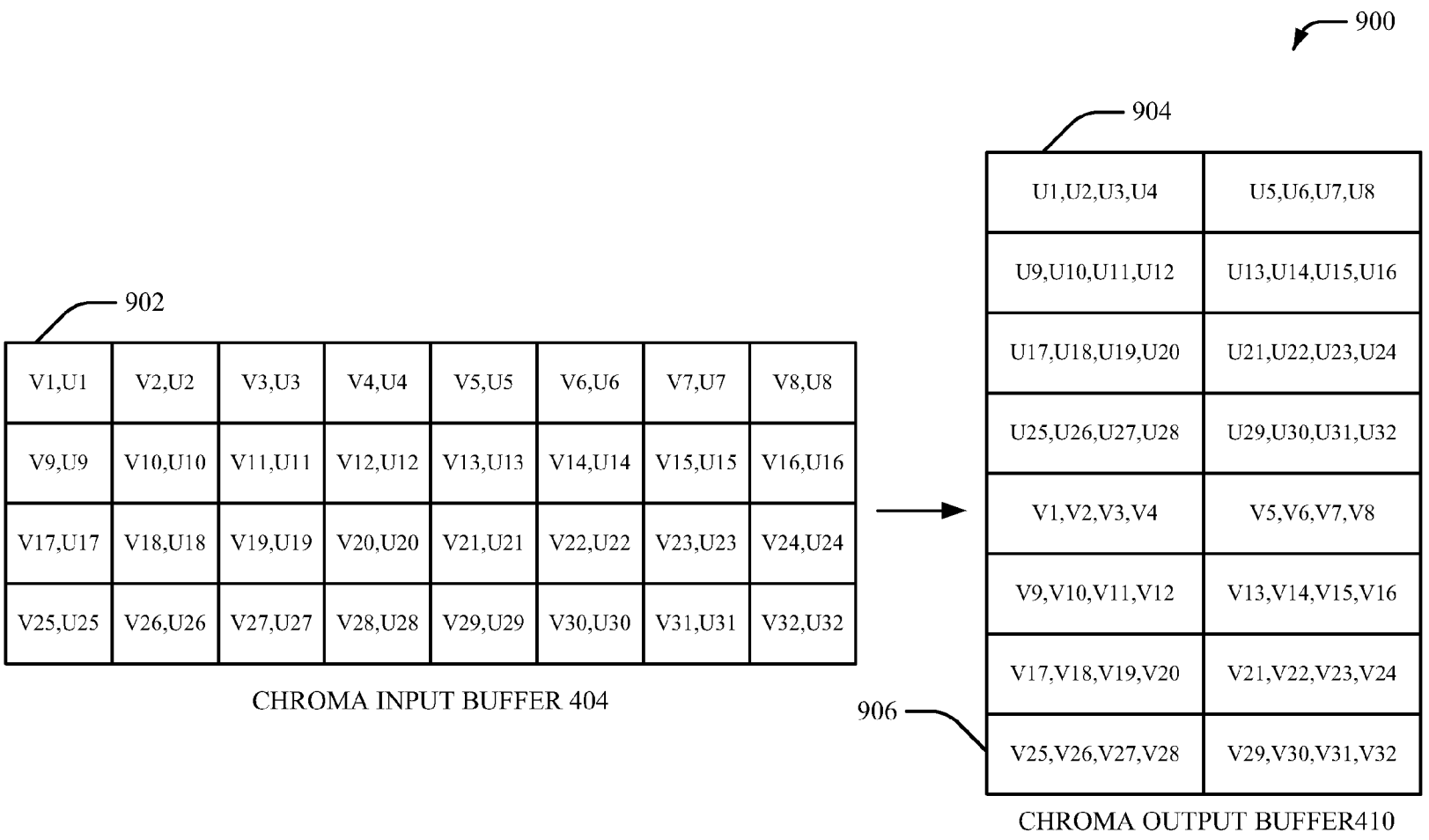
FIG. 9 illustrates a non-limiting implementation for transforming a semi-planar chroma input buffer into a planar chroma output buffer, in accordance with various aspects and implementations described herein.

Referring now to FIG. 9, there is illustrated a non-limiting implementation of a system 900 for transforming a semi-planar chroma input buffer into a planar chroma output buffer in accordance with this disclosure. Semi-planar image frame data (e.g., chrominance data) stored in the chroma input buffer 404 can be transformed and stored as planar image frame data (e.g., chrominance data) in the chroma output buffer 410. In the example shown in FIG. 9, the chroma input buffer 404 is formed in response to data received from a 16×8 source image. The chroma input buffer 404 can include one or more pixels (e.g., pixels V1, U1-V32, U32 shown in FIG. 9). For example, a pixel 902 includes two chroma components (e.g., two pixels) V1, U1. The size of the chroma input buffer 404 can be configured to be half the size of the source image. Therefore, the chroma input buffer 404 shown in FIG. 9 is an 8×4 buffer. The chroma output buffer 410 can group the pixels from the chroma input buffer 404. For example, a plurality of U component pixels can be grouped together and a plurality of V component pixels can be grouped together. For example, an output pixel 904 can include pixels U1, U2, U3 and U4 (e.g., four pixels) and an output pixel 906 can include pixels V25, V26, V27 and V28 (e.g., four pixels). As such, the chroma input buffer 404 can represent a format that includes two components per pixel and the chroma output buffer 410 can represent a format that includes four components per pixel. For example, the chroma output buffer 410 shown in FIG. 9 is a 2×8 buffer. The top half of the chroma output buffer 410 can include U component data and the bottom half of the chroma output buffer 410 can include V component data. Alternatively, the top half of the chroma output buffer 410 can include V component data and the bottom half of the chroma output buffer 410 can include U component data. In one example, a stride vector for the 16×8 source image can be set to ⅛, 0. It is to be appreciated that size and/or formatting of the chroma input buffer 404 and/or the chroma output buffer 410 can be varied to meet the design criteria of a particular implementation (e.g., a particular YUV format).

A vertex shader can be programmed to interpolate across the entire source space and destination space. Therefore, a fragment shader can allow the source coordinates to wrap. For the top half of the destination (e.g., the chroma output buffer 410), the chrominance component U can be sampled from 0<=srcY<1. For the bottom half of the destination (e.g., the chroma output buffer 410), the chrominance component V can be sampled from 0<=srcY<1. Therefore:

For top half of output:
realSrcX=inputSrcX
realSrcY=2*inputSrcY
For the bottom half of output:
realSrcX=inputSrcX
realSrcY=2*(inputSrcY−0.5)

Figure 10:
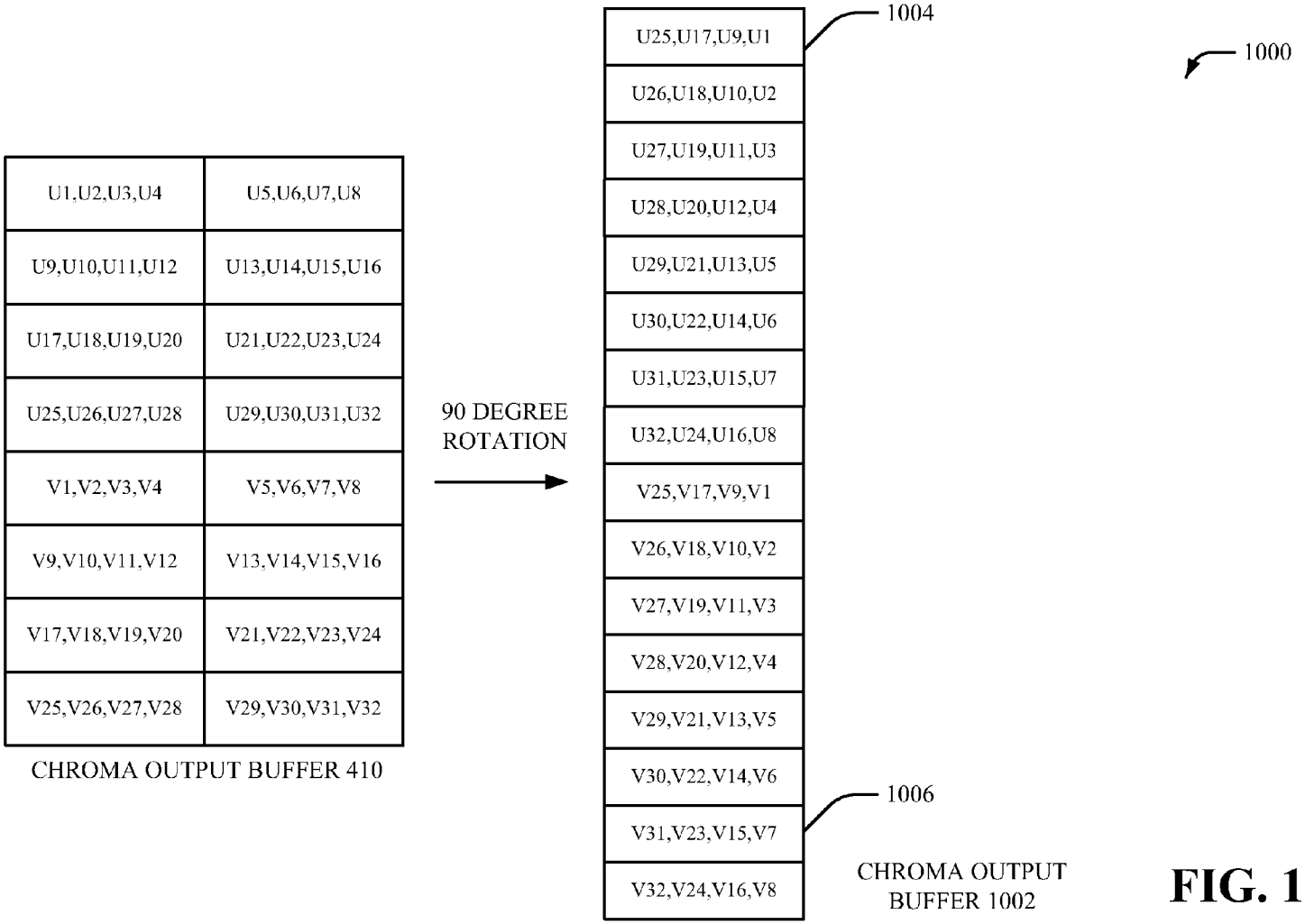
FIG. 10 illustrates a non-limiting implementation for rotating a planar chroma output buffer, in accordance with various aspects and implementations described herein.

Referring now to FIG. 10, there is illustrated a non-limiting implementation of a system 1000 for rotating a planar chroma output buffer in accordance with this disclosure. In the example shown in FIG. 10, the chroma output buffer 410 (also shown in FIG. 9) is rotated 90 degrees to generate a chroma output buffer 1002 (e.g., a new chroma output buffer). The chroma output buffer 1002 can include the same pixels (e.g., the same number of pixels and/or the same type of pixels) as the chroma output buffer 410. However, the chroma output buffer 1002 can rearrange the pixels from the chroma output buffer 410 to represent a rotation (e.g., a 90 degree rotation). For example, an output pixel 1004 can include pixels U25, U17, U9 and U1 and an output pixel 1006 can include pixels V31, V23, V16 and V8. The chroma output buffer 1002 shown in FIG. 10 is a 1×16 buffer.

For 90 degrees of rotation, to go from U25 to U17 involves moving vertically in the source image. Therefore, the stride vector can be set to 0,¼, since moving one pixel to the right in destination space involves moving vertically ¼ of the image in source space. As such, for 90 degrees of rotation, for the top half of the destination (e.g., the chroma output buffer 410), the chrominance component U is sampled from 0<=srcX<1. From 8<=dstY<=15, the chrominance component V is sampled from 0<=srcX<1.

Therefore, for a rotation of 90 degrees, the coordinates are:
For top half of output:
realSrcX=2*rotatedSrcX
realSrcY=rotatedSrcY
For the bottom half of output:
realSrcX=2*(rotatedSrcX−0.5)
realSrcY=rotatedSrcY
For a rotation of 270 degrees, the coordinates are:
For top half of output:
realSrcX=2*(rotatedSrcX−0.5)
realSrcY=rotatedSrcY
For the bottom half of output:
realSrcX=2*rotatedSrcX
realSrcY=rotatedSrcY Additionally or alternatively, the rotation component 602 can implement a bias vector and/or a scale vector. For example, for 0 and 180 degrees of rotation, scaleX=1 and scaleY=2, respectively. For 90 and 270 degree of rotation, scaleX=2 and scaleY=1, respectively. The bias vector can be rotated by the source rotation matrix so that in a non-rotated scenario, the bias vector is zero for the top half of the destination (e.g., the chroma output buffer 410) and the bias vector is 0.5 for the bottom half of the destination (e.g., the chroma output buffer 410). Therefore, the coordinates can be computed as follows:

$$realSrcX=scaleX*(rotatedSrcX-biasX)$$

$$realSrcY=scaleY*(rotatedSrcY-biasY)$$

Figure 11:
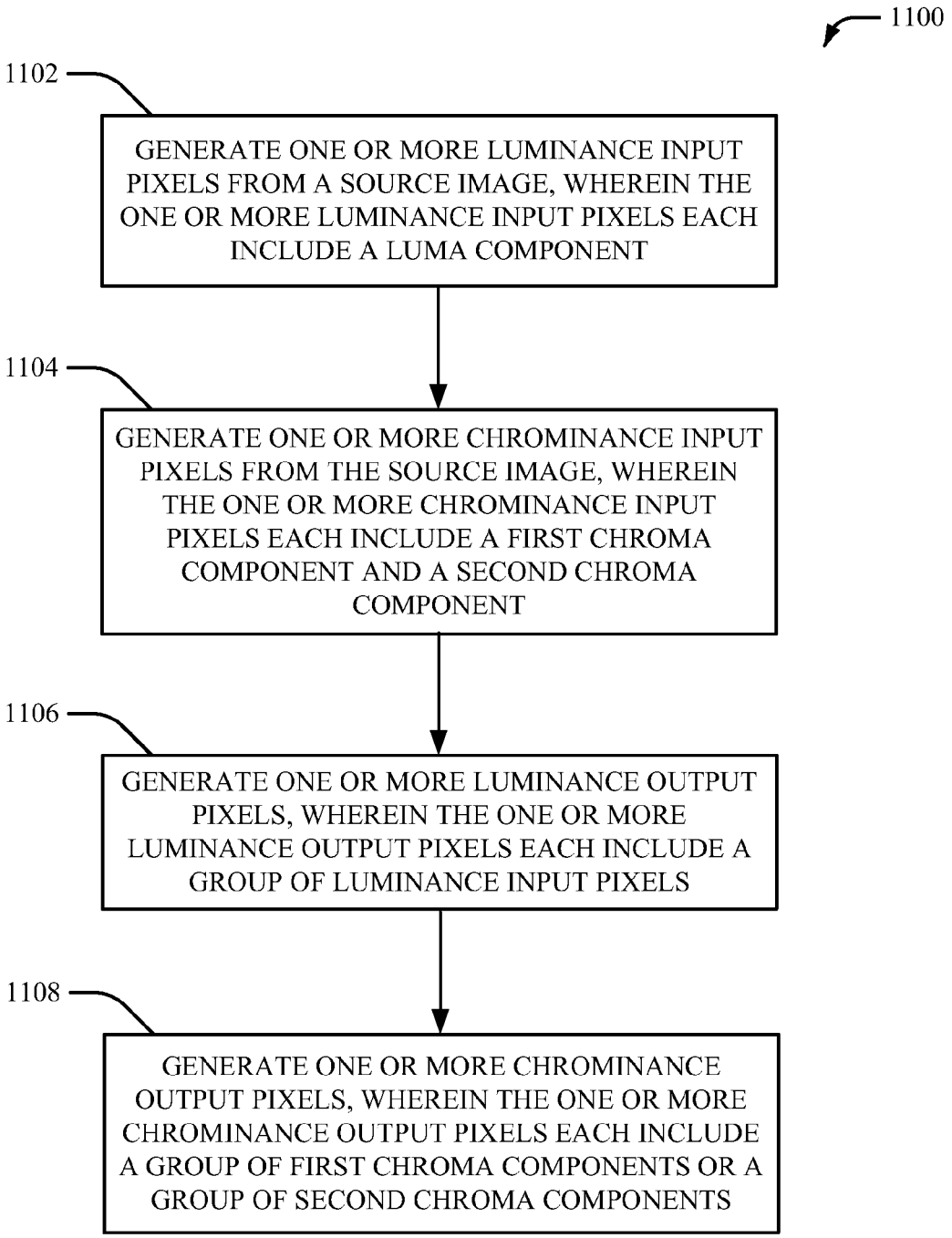
FIG. 11 depicts a flow diagram of an example method for converting a YUV color space format of an image frame to another YUV color space format, in accordance with various aspects and implementations described herein.
Figure 12:
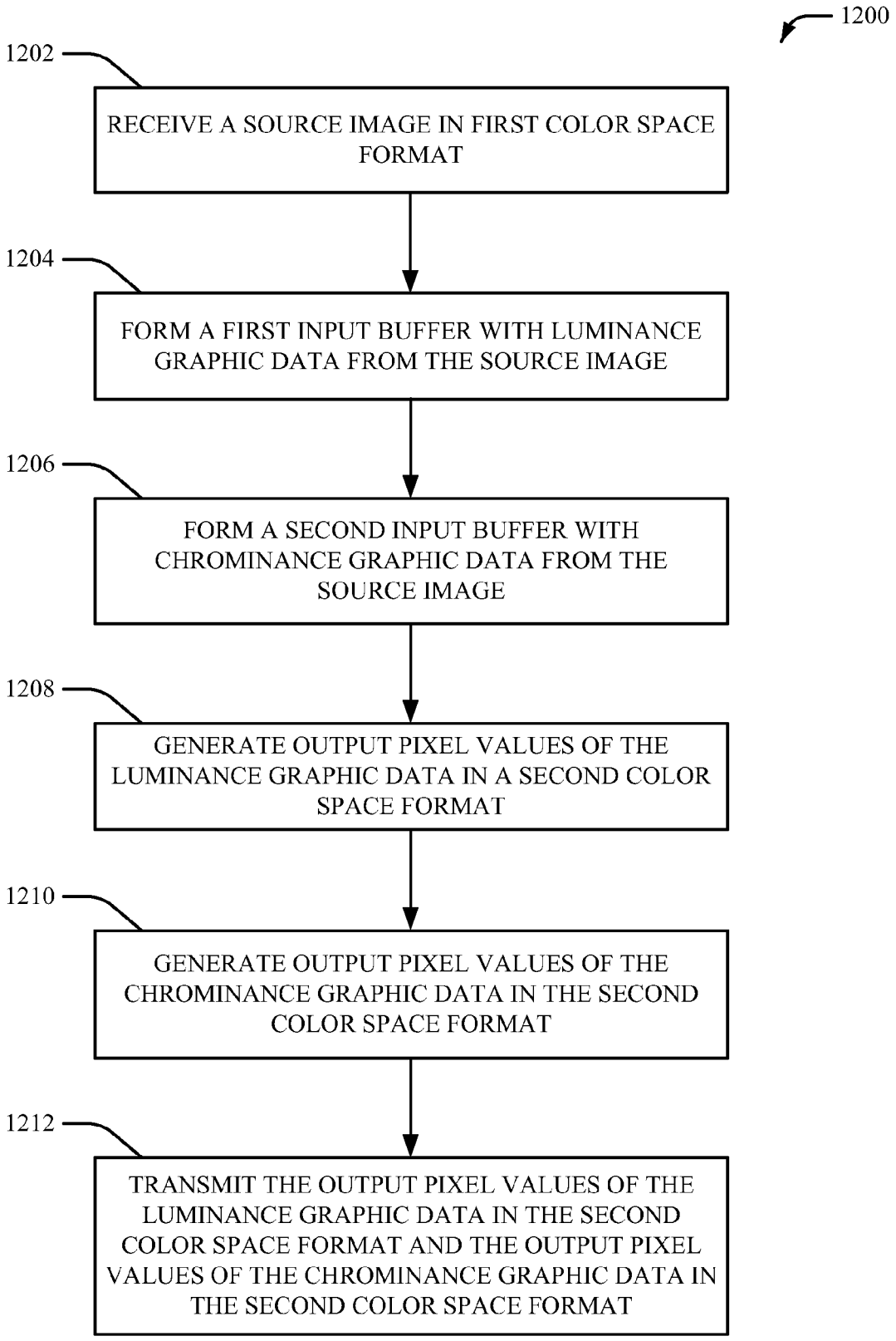
FIG. 12 depicts a flow diagram of an example method for implementing a system to convert a YUV color space format of an image frame to another YUV color space format, in accordance with various aspects and implementations described herein.

FIGS. 11-12 illustrate methodologies and/or flow diagrams in accordance with the disclosed subject matter. For simplicity of explanation, the methodologies are depicted and described as a series of acts. It is to be understood and appreciated that the subject innovation is not limited by the acts illustrated and/or by the order of acts, for example acts can occur in various orders and/or concurrently, and with other acts not presented and described herein. Furthermore, not all illustrated acts may be required to implement the methodologies in accordance with the disclosed subject matter. In addition, those skilled in the art will understand and appreciate that the methodologies could alternatively be represented as a series of interrelated states via a state diagram or events. Additionally, it should be further appreciated that the methodologies disclosed hereinafter and throughout this specification are capable of being stored on an article of manufacture to facilitate transporting and transferring such methodologies to computers. The term article of manufacture, as used herein, is intended to encompass a computer program accessible from any computer-readable device or storage media.

Referring to FIG. 11, there illustrated is a methodology 1100 for converting an image frame from one YUV format to another YUV format, according to an aspect of the subject innovation. As an example, methodology 1100 can be utilized in various computer devices and/or applications, such as, but not limited to, media capturing systems, media displaying systems, computing devices, cellular phones, tablets, personal data assistants (PDAs), laptops, personal computers, audio/video devices, etc. The methodology 1100 is configured to transform luminance output pixels and chrominance output pixels. Specifically, methodology 1100 is configured to separately transform luminance input pixels in a particular YUV format directly to luminance output pixels in another YUV format, and chrominance input pixels in a particular YUV format directly to chrominance output pixels in another YUV format.

Initially, image and/or video information can be captured or can be contained within memory. At 1102, one or more luminance input pixels can be generated (e.g., using a texture component 104) from a source image. The one or more luminance input pixels can each include a luma component. For example, a luminance input buffer 402 in the texture component 104 can be formed to include luminance pixels (e.g., the pixels A-X) from a source image. At 1104, one or more chrominance input pixels can be generated (e.g., using texture component 104) from the source image. The one or more chrominance input pixels can each include a first chroma component and a second chroma component. For example, the chroma input buffer 404 in the texture component 104 can be formed to include chrominance pixels (e.g., the pixels V1, U1-V32, U32) from the source image. At 1106, one or more luminance output pixels can be generated (e.g., using luminance component 106). The one or more luminance output pixels can each include a group of luminance input pixels. For example, an output pixel (e.g., the pixel 802) with a group of luminance input pixels can include the pixels A, B, C and D. At 1108, one or more chrominance output pixels can be generated (e.g., using chrominance component 108). The one or more chrominance output pixels can each include a group of first chroma components or a group of second chroma components. For example, an output pixel (e.g., the pixel 904) with a group of first chrominance components can include pixels U1, U2, U3 and U4, and an output pixel (e.g., the pixel 906) with a group of second chrominance components can include pixels V1, V2, V3 and V4.

Referring to FIG. 12, there illustrated is a methodology 1200 for implementing a system to convert a format of an image frame. At 1202, a source image in first color space format can be received (e.g., by GPU 202 from a central processing unit (CPU)). For example, the CPU 204 can present a semi-planar image frame to the GPU 202. At 1204, a first input buffer can be formed (e.g., using texture component 104) with luminance graphic data from the source image. For example, the luminance input buffer 402 can be formed with luminance component data (e.g., luminance pixels A-X). At 1206, a second input buffer can be formed (e.g., using texture component 104) with chrominance graphic data from the source image. For example, the chroma input buffer 404 can be formed with U chrominance component data (e.g., chrominance pixels U1-U32) and V chrominance component data (e.g., chrominance pixels V1-V32). At 1208, output pixel values of the luminance graphic data can be generated (e.g., using luminance component 106) in a second color space format. For example, the luminance output buffer 408 can be formed (e.g., using the luminance component 106) with luminance pixels formatted for a planar image frame. At 1210, output pixel values of the chrominance graphic data can be generated (e.g., using chrominance component 108) in the second color space format. For example, the chroma output buffer 410 can be formed (e.g., using the chrominance component 108) with chrominance pixels formatted for a planar image frame. At 1212, the output pixel values of the luminance graphic data in the second color space format and the output pixel values of the chrominance graphic data in the second color space format can be transmitted (e.g., using GPU 202 to the CPU). For example, the GPU 202 can present a planar image frame to the CPU 204. The planar image frame can include luminance and chrominance pixel data from the luminance output buffer 408 and the chroma output buffer 410. It is to be appreciated that the methodology 1200 can also be similarly implemented to convert a planar image frame to a semi-planar image frame.

What has been described above includes examples of the implementations of the present invention. It is, of course, not possible to describe every conceivable combination of components or methodologies for purposes of describing the claimed subject matter, but it is to be appreciated that many further combinations and permutations of the subject innovation are possible. Accordingly, the claimed subject matter is intended to embrace all such alterations, modifications, and variations that fall within the spirit and scope of the appended claims. Moreover, the above description of illustrated implementations of the subject disclosure is not intended to be exhaustive or to limit the disclosed implementations to the precise forms disclosed. While specific implementations and examples are described herein for illustrative purposes, various modifications are possible that are considered within the scope of such implementations and examples, as those skilled in the relevant art can recognize.

As used in this application, the terms "component," "module," "system," or the like are generally intended to refer to a computer-related entity, either hardware (e.g., a circuit), a combination of hardware and software, software, or an entity related to an operational machine with one or more specific functionalities. For example, a component may be, but is not limited to being, a process running on a processor (e.g., digital signal processor), a processor, an object, an executable, a thread of execution, a program, and/or a computer. By way of illustration, both an application running on a controller and the controller can be a component. One or more components may reside within a process and/or thread of execution and a component may be localized on one computer and/or distributed between two or more computers.

The systems and processes described above can be embodied within hardware, such as a single integrated circuit (IC) chip, multiple ICs, an application specific integrated circuit (ASIC), or the like. Further, the order in which some or all of the process blocks appear in each process should not be deemed limiting. Rather, it should be understood that some of the process blocks can be executed in a variety of orders that are not illustrated herein.

In regards to the various functions performed by the above described components, devices, circuits, systems and the like, the terms used to describe such components are intended to correspond, unless otherwise indicated, to any component which performs the specified function of the described component (e.g., a functional equivalent), even though not structurally equivalent to the disclosed structure, which performs the function in the herein illustrated exemplary aspects of the claimed subject matter. In this regard, it will also be recognized that the innovation includes a system as well as a computer-readable storage medium having computer-executable instructions for performing the acts and/or events of the various methods of the claimed subject matter.

The aforementioned systems/circuits/modules have been described with respect to interaction between several components/blocks. It can be appreciated that such systems/circuits and components/blocks can include those components or specified sub-components, some of the specified components or sub-components, and/or additional components, and according to various permutations and combinations of the foregoing. Sub-components can also be implemented as components communicatively coupled to other components rather than included within parent components (hierarchical). Additionally, it should be noted that one or more components may be combined into a single component providing aggregate functionality or divided into several separate sub-components, and any one or more middle layers, such as a management layer, may be provided to communicatively couple to such sub-components in order to provide integrated functionality. Any components described herein may also interact with one or more other components not specifically described herein but known by those of skill in the art.

Reference throughout this specification to "one embodiment" or "an embodiment" or "one implementation" or "an implementation" means that a particular feature, structure, or characteristic described in connection with the embodiment or implementation is included in at least one embodiment or implementation. Thus, the appearances of the phrase "in one embodiment" or "in an embodiment" or "in one implementation" or "in an implementation" in various places throughout this specification are not necessarily all referring to the same embodiment or implementation.

In addition, while a particular feature of the subject innovation may have been disclosed with respect to only one of several implementations, such feature may be combined with one or more other features of the other implementations as may be desired and advantageous for any given or particular application. Furthermore, to the extent that the terms "includes," "including," "has," "contains," variants thereof, and other similar words are used in either the detailed description or the claims, these terms are intended to be inclusive in a manner similar to the term "comprising" as an open transition word without precluding any additional or other elements.

What is claimed is:

1. A system, comprising:

a memory that stores computer executable components; and a processor that executes the following computer executable components stored within the memory:

a texture component that generates two or more luminance input pixels and two or more chrominance input pixels from a source image, wherein the two or more luminance input pixels each include a luma component and the two or more chrominance input pixels each include a first chroma component and a second chroma component;

a luminance component that generates one or more luminance output pixels, wherein the one or more luminance output pixels each include a group of luma components from a plurality of the luminance input pixels; and a chrominance component that generates one or more chrominance output pixels, wherein the one or more chrominance output pixels each include a group of first chroma components from a plurality of the chrominance input pixels or a group of second chroma components from the plurality of the chrominance input pixels.

2. The system of claim 1, wherein a first set of chrominance output pixels includes the group of first chroma components and a second set of chrominance output pixels includes the group of second chroma components.

3. The system of claim 1, wherein the one or more luminance output pixels includes luma components from four of the luminance input pixels.

4. The system of claim 3, wherein the computer executable components stored within the memory further comprises:

a vector stride component that generates a vector to indicate spacing between the one or more luminance input pixels as represented by the one or more luminance output pixels.

5. The system of claim 4, wherein the vector stride component presents the vector to an adjacent pixel on a right side of a particular input pixel if no rotation is performed on the one or more luminance output pixels or the one or more chrominance output pixels.

6. The system of claim 4, wherein the vector stride component presents the vector to an adjacent pixel below a particular input pixel if a rotation is performed on the one or more luminance output pixels or the one or more chrominance output pixels.

7. The system of claim 1, wherein the computer executable components stored within the memory further comprises:

a rotation component that generates one or more rotated chrominance output pixels, wherein the one or more rotated chrominance output pixels include a first chroma component from each group of first chroma components or a second chroma component from each group of second chroma components.

8. The system of claim 7, wherein the rotation component implements a vector.

9. The system of claim 1, further comprising:

a scaling component that resizes the one or more luminance output pixels or the one or more chrominance output pixels.

10. The system of claim 1, wherein the processor is a graphic processing unit (GPU).

11. The system of claim 1, wherein the one or more luminance input pixels and the one or more chrominance input pixels are configured in a first color space format and the one or more luminance output pixels and the one or more chrominance output pixels are configured in a second color space format.

12. The system of claim 11, wherein the luma components included in the one or more luminance output pixels are not converted from the first color space format to the second color space format.

13. The system of claim 11, wherein the first color space format is a YUV format and the second color space format is a RGB format.

14. A method, comprising:

employing a microprocessor to execute computer executable instructions stored in a memory to perform the following acts:

generating two or more luminance input pixels from a source image, wherein the two or more luminance input pixels each include a luma component;

generating two or more chrominance input pixels from the source image, wherein the two or more chrominance input pixels each include a first chroma component and a second chroma component;

generating one or more luminance output pixels, wherein the one or more luminance output pixels each include a group of luma components from a plurality of the luminance input pixels; and generating one or more chrominance output pixels, wherein the one or more chrominance output pixels each include a group of first chroma components from a plurality of the chrominance input pixels or a group of second chroma components from the plurality of the chrominance input pixels.

15. The method of claim 14, further comprising generating a vector to indicate spacing between the luma components of the one or more luminance input pixels included in the one or more luminance ouput pixels.

16. The method of claim 15, further comprising presenting the vector to an adjacent pixel on a right side of a particular input pixel if no rotation is performed.

17. The method of claim 15, further comprising presenting the vector to an adjacent pixel below a particular input pixel if a rotation is performed.

18. The method of claim 14, further comprising generating one or more rotated chrominance output pixels, wherein the one or more rotated chrominance output pixels include a first chroma component from each group of first chroma components or a second chroma component from each group of second chroma components.

19. The method of claim 14, further comprising scaling the one or more luminance output pixels and the one or more chrominance output pixels.

20. A method, comprising:

receiving at a graphics processing unit (GPU) a source image in first color space format from a central processing unit (CPU);

forming a first input buffer with luminance graphic data from the source image;

forming a second input buffer with chrominance graphic data from the source image;

generating, by the GPU, output pixel values of the luminance graphic data by grouping a plurality of luminance components from the first input buffer into a luminance output pixel configured in a second color space format;

generating, by the GPU, output pixel values of the chrominance graphic data by grouping a plurality of chrominance components from the first input buffer into a chrominance output pixel configured in the second color space format; and transmitting the output pixel values of the luminance graphic data in the second color space format and the output pixel values of the chrominance graphic data in the second color space format to the CPU.

21. The method of claim 20, wherein the first color space format is a YUV format and the second color space format is a RGB format.

22. The method of claim 20, wherein the output pixel values of the luminance and chrominance graphic data are stored in a GPU frame buffer, and wherein the GPU frame buffer does not support a configuration in the first color space format.

* * * * *